US006439902B1

(12) United States Patent
Cole et al.

(10) Patent No.: US 6,439,902 B1
(45) Date of Patent: Aug. 27, 2002

(54) PRE-SET LOCKS FOR A CONNECTOR LEVER

(75) Inventors: Bryan Donald Cole, Canton; Wesley Richard Corrion, Fenton, both of MI (US)

(73) Assignee: Yazaki North America

( * ) Notice: Subject to any disclaimer, the term of this patent is extended or adjusted under 35 U.S.C. 154(b) by 0 days.

(21) Appl. No.: 09/711,426

(22) Filed: Nov. 13, 2000

(51) Int. Cl.[7] ..... H01R 13/62
(52) U.S. Cl. ..... 439/157
(58) Field of Search ..... 439/157, 151, 439/153, 159, 160

(56) References Cited

U.S. PATENT DOCUMENTS

| | | | | |
|---|---|---|---|---|
| 4,447,101 A | | 5/1984 | Gugliotti | 439/153 |
| 5,135,410 A | | 8/1992 | Kawase et al. | |
| 5,230,635 A | | 7/1993 | Takenouchi et al. | 439/157 |
| 5,257,942 A | | 11/1993 | Taguchi | 439/157 |
| 5,273,447 A | | 12/1993 | Heiney | 439/160 |
| 5,401,179 A | * | 3/1995 | Sinchi et al. | 439/157 |
| 5,427,539 A | | 6/1995 | Saito | 439/157 |
| 5,575,671 A | | 11/1996 | Katsuma | 439/157 |
| 5,709,560 A | | 1/1998 | Hio | 439/157 |

* cited by examiner

*Primary Examiner*—Tulsidas Patel
(74) *Attorney, Agent, or Firm*—Young & Basile

(57) ABSTRACT

A releasable lever-mounted lock mechanism for securing an electrical connector lever in a pre-set position on a connector body. The lever has cam slots and is located on a first connector. The lock in a preferred form comprises an L-shaped, deflectable arm formed in the sidewall of the lever. A free end of the arm has a ramp-shaped stop portion. The second end of the arm is joined to the lever sidewall in cantilever fashion such that the arm deflects relative to the lever. A flat surface of the stop snaps behind an edge of the first connector in the preset position, with the arm in an undeflected position. The lever is thereby locked in the pre-set position, allowing a second connector with cam posts to be brought into initial mating contact with the first connector. The cam posts enter the slots of the lever. A release projection on the L-shaped lock arm is contacted by the shroud of the second connector. This deflects the lock arm, releasing the stop from the edge of the first connector. The lever can then be pivoted and the cam interaction between the lever slots and second connector side posts draws the connectors into electrical engagement.

12 Claims, 4 Drawing Sheets

PRE-SET LOCKS FOR A CONNECTOR LEVER

FIELD OF THE INVENTION

This invention relates in general to lever-operated electrical connector assemblies of the type used in automotive wiring harnesses, and more specifically to a releasable lock mechanism for such levers.

BACKGROUND OF THE INVENTION

Motor vehicle wire harnesses for distributing electrical power to various vehicle components must be electrically mated. The wires in these harnesses are generally attached to pin or socket terminals secured in a connector. The connector must be mated to another connector such that the terminals are electrically engaged. For example, a female connector containing female socket terminals is typically mated with a male or plug connector containing male pin terminals. The more terminals to be mated, the higher the force needed to push the connectors together.

In order to reduce the connector insertion force, a force-reducing lever is often mounted on one of the connectors, typically the female connector, to engage the other (typically male) connector upon its initial insertion and thereafter to apply leverage on the male connector to draw it into full connection. In a typical lever arrangement, cam slots in the upright lever receive posts on the mating connector just prior to terminal contact. When the lever is pivoted downwardly, the cam action between the lever slots and the posts draws the connectors together and inserts the male terminals into the female terminals to complete their electrical engagement. A bridge portion of the lever frequently includes a latch cooperating with a latch receiver on the connector body to lock the lever and both connectors in the electrically engaged position. An example of such a connector assembly is illustrated in U.S. Pat. No. 5,401,179.

Unless the lever is held in an open, ready-to-receive position, the lever can interfere with the initial engagement of the connectors. If the lever is not aligned properly, the posts on the mating connector will not enter the cam slots on the lever without further adjustment by the assembler.

In U.S. Pat. No. 5,135,410, side arms of a lever on a socket connector are provided with engagement projections that cooperate with stops on the connector walls to hold the lever in a release position. Preliminary insertion of a plug connector expands the side arms of the lever outwardly, disengaging the cooperating projections and allowing the lever to be pivoted from the release position to a locked position wherein the terminals of each connector are electrically engaged. This type of lock requires projections on both connectors and elasticity of the entire side arms of the lever. A special design of the socket connector housing, with inner and outer walls, is needed along with a pushing force able to expand the side arms of the lever.

U.S. Pat. No. 5,709,560 discloses the use of projections on each leg of a lever for engagement with holes in a hood portion of a female connector housing to hold the lever in a fitting-starting or pre-set position. An engagement release piece portion on a male connector housing forces the projections out of the engagement holes when the male connector housing is slightly fitted in the female connector housing. This assembly requires precisely cooperating projections on the male connector housing and lever and properly positioned holes in the female connector housing.

SUMMARY OF THE INVENTION

The present invention is a lever-mounted lock for securing the lever in a preset position on a connector, preventing the lever from interfering with a mating connector during initial engagement of the connectors.

The lever-mounted lock mechanism features a universal release mechanism designed to be automatically engaged by the mating connector upon initial engagement of the connectors regardless of whether the connectors are precisely aligned. The lever-mounted lock mechanism alone responds to mating connector insertion for release; the lever as a whole is unaffected, and simply receives the mating connector posts in its cam slots.

In carrying out this invention in the illustrative embodiment thereof, a first connector has a lever for electrically connecting a second connector with the first connector. The lever has sides with slots for receiving posts on the second connector. Inner sidewalls of the lever contain independently flexible arms for securing the lever in a pre-set or open position in which the lever and its cam slots remain properly set for initial engagement with the mating connector. The lock arms are preferably contained within the plane of lever sidewalls and each comprises a deflectable, L-shaped cutout integral with and cantilevered from the lever sidewall. The free end of the arm has a stop engaging the first connector to lock it in a pre-set position.

The free end of the lock arm also includes a leading dimple or release projection located forwardly of the pre-set stop relative to the mating connector in the pre-set position. When the mating connector is moved into initial engagement with the lever connector, the mating connector contacts the dimple even if misaligned and the lock arm and its pre-set stop are deflected away from the first connector. The lever is therefore released as the posts on the second connector enter the lever cam slots. The lever is then manually pivoted to draw the connectors into complete electrical engagement without interference from the lever locking structure.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
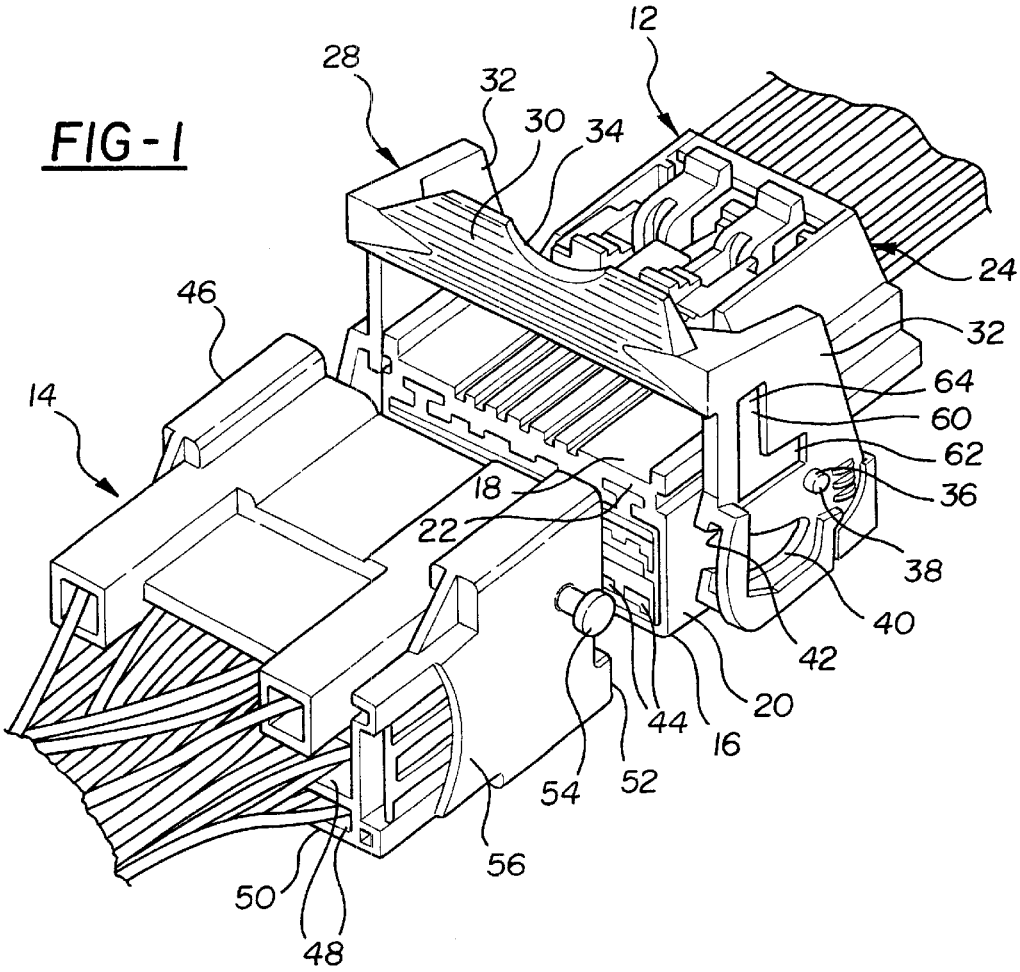
FIG. 1 is a perspective view of a connector assembly according to the present invention, with first and second connectors in an unmated condition and a lever on the first connector in a pre-set position.

Referring now to FIG. 1, a connector assembly according to the present invention comprises a first, female connector 12 and a second, mating male connector 14. The first connector has a housing 16 with a top wall 18, opposite side walls 20, a mating end 22 and a terminal insertion end 24. The housing includes an edge or ridge 26 (hidden in FIG. 1, shown in FIGS. 5, 5A, 6A, 8 and 9) on each side wall 20 with a stop surface facing the mating end 22 of first connector 12. A lever 28 is supported on the first connector housing 16 with apertures 36 mounted for pivotal or rotational movement on cylindrical bearing projections 38 relative to the housing. The lever is generally U-shaped with a bridge 30 extending between two sidewalls or legs 32. The bridge includes a ledge 34 providing a convenient leverage point and grasping surface. Front edges of the lever sidewalls are provided with openings 42 leading into curved cam slots 40. The connector has terminal accommodating chambers 44 for receiving female socket terminals on the ends of electrical wires through the terminal insertion end 24.

The second (mating) connector 14 has a housing with a surrounding shroud 46 located forwardly at its mating end 52. Shroud 46 is sized to fit over the housing 16 of connector 12 and between housing 16 and lever 28 as connectors 12 and 14 are mated, in known fashion. Terminal accommodating chambers 48 extend from a terminal insertion end 50 of the connector 14 to mating end 52. The chambers receive male pin or plug terminals on the ends of electrical wires through terminal insertion end 50. Short cam posts 54 extend outwardly from shroud sidewalls 56 of the second connector 14.

Both connectors are made from plastic, with different types of plastic being used for various portions in known manner. Nylon, acetal resin, and various polyethylenes are examples.

Figure 2:
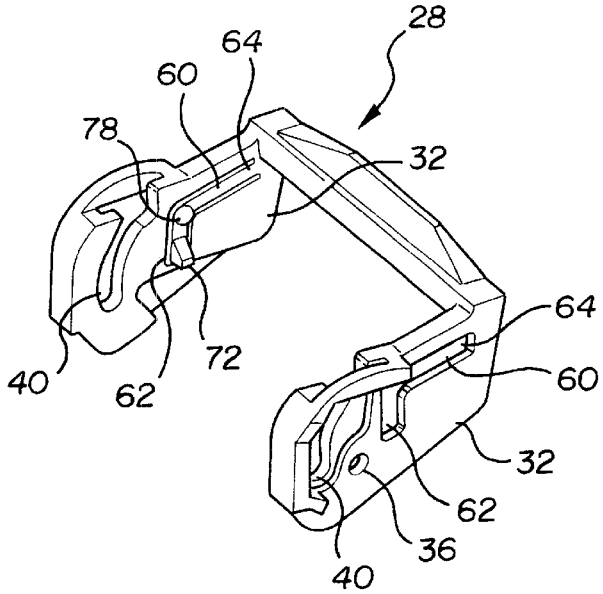
FIG. 2 is a perspective view of the lever separated from the first connector, rotated 90° from the upright position of FIG. 1.
Figure 3:
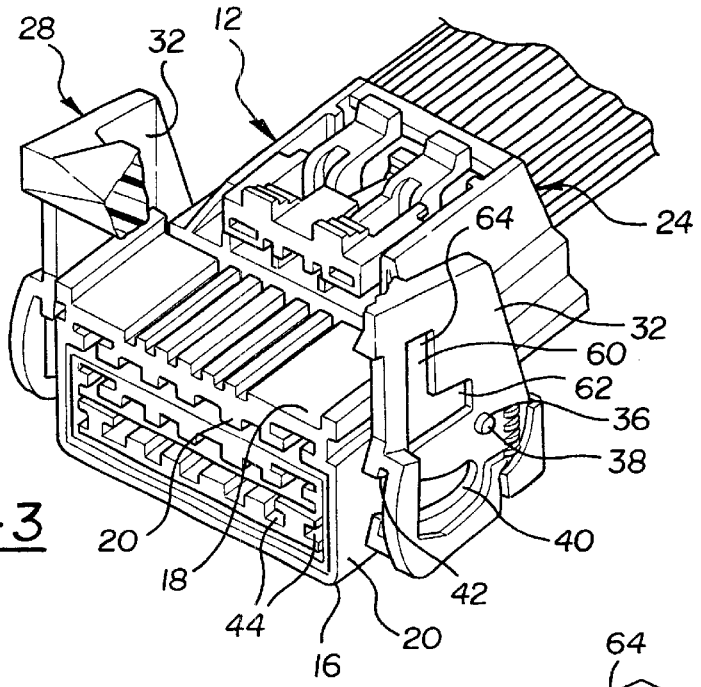
FIG. 3 is a partial cut-away, perspective view of the connector assembly with the connectors in an initial contact condition.

A lever-mounted lock device according to the present invention is best illustrated in FIGS. 2 and 3. Each lever sidewall 32 includes a lock device comprising an L-shaped arm 60 with a first free end 62 and a second end 64 integral with the lever side. The L-shaped arm can be formed during molding of the lever and is preferably within the plane of the lever sidewall in its undeflected condition as shown in FIGS. 1 and 2. The cantilevered arm 60 is capable of flexing outwardly from the lever sidewall 32, especially at free end 62.

A pre-set stop 72 is formed on the inside (connector-facing) surface of free end 62. In the illustrated embodiment, stop 72 is a ramp with an inclined surface 74 aligned with free end 62 of the arm. A flat stop surface 76 generally perpendicular to the arm's inner surface faces rearwardly in the pre-set lever position of FIG. 1. A rounded release projection or dimple 78 (in the illustrated embodiment having the shape of a hemisphere) is located forwardly of stop 72 relative to the mating connector in the pre-set position of FIG. 1. Dimple 78 projects from the inner surface of the lock arm for at least as high as stop 72.

Figure 5:
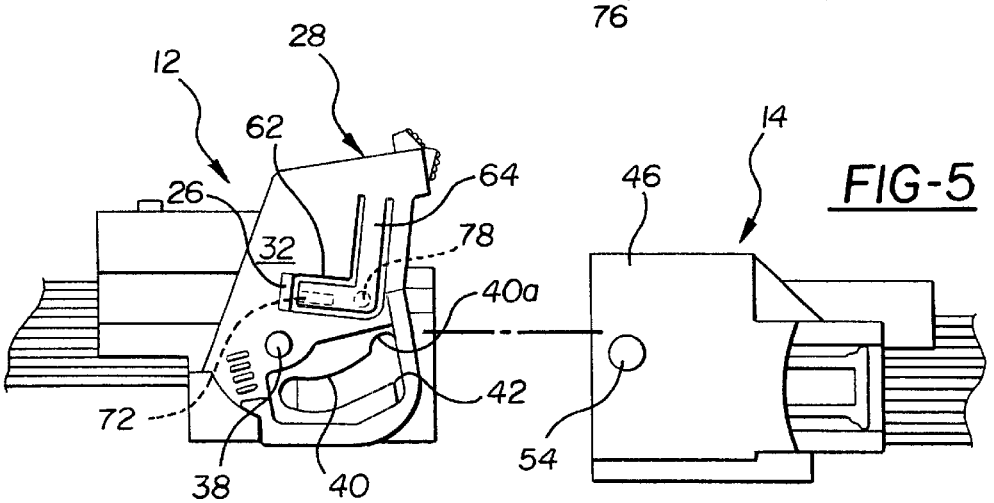
FIG. 5 is a side elevational view of the connector assembly in the unmated, pre-set condition of FIG. 1.
Figure 5A:
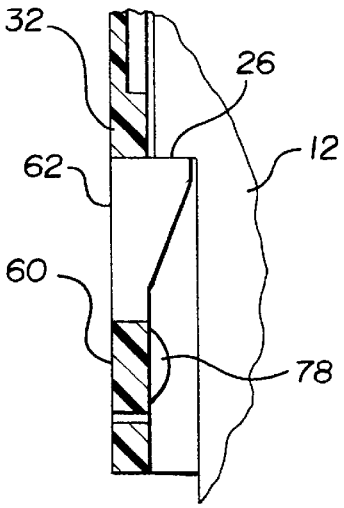
FIG. 5A is a close-up plan view of the lock arm pre-set stop and its pre-set engagement with the connector housing.

To position the lever in a pre-set or fully open position as best illustrated in FIGS. 1 and 3, the lever is rotated to an upright position at the mating end 22 of first connector 12 as shown, with the inclined surface 74 of stop 72 riding over and then snapping in front of ridge 26 on the connector housing (FIG. 5A). Release dimple 78 on each lock device is spaced from sidewall 20 of housing 16 throughout the range of lever motion on connector 12. The inclined surface 74 of ramp portion 72 encounters ridge 26 on the side wall of the housing as the lever is rotated to its upright position. Lock arm 60 is deflected away from lever sidewall 32 as contact between the inclined surface 74 and the ridge 26 on the housing progressively forces the ramp portion outwardly. As the lever reaches its upright position, ramp 72 passes ridge 26 and the flat lower stop surface 76 snaps into place against a forward-facing portion of ridge 26 to lock the lever in the upright, pre-set position.

Figure 4:
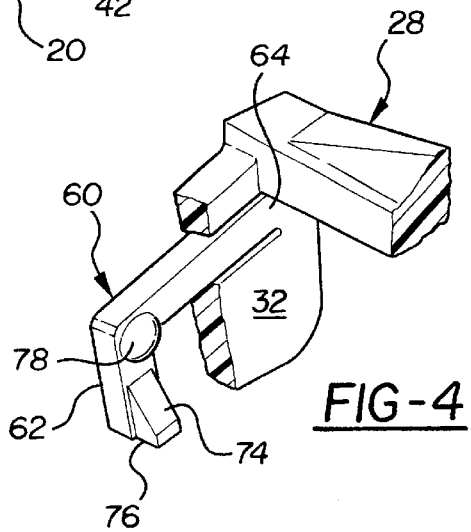
FIG. 4 is an enlarged cut-away view of part of the lever side-wall and its pre-set lock device.

FIGS. 3–5 best illustrate the main function of the lock device. The lock arm 60 secures the lever in the pre-set position on the first connector. In this pre-set position, the L-shaped arms are not deflected. The flat stop surface 76 of ramped stop 72 on each lock arm abuts the ridge on the side wall of the first connector housing (FIG. 5A). The lever is thereby locked in this upright, pre-set position and cannot rotate rearwardly. The pre-set condition presents unobstructed access to the shroud 46 of the mating connector 14, which can be inserted into and over the first connector 12 without interference from the lever. The pre-set position of the lever also pre-aligns the openings 42 of curved cam slots 40 in the sides of lever 28 to receive cam posts 54 extending from the sidewalls of the mating connector 14 when the mating ends of the connectors are brought into initial contact.

Figure 6:
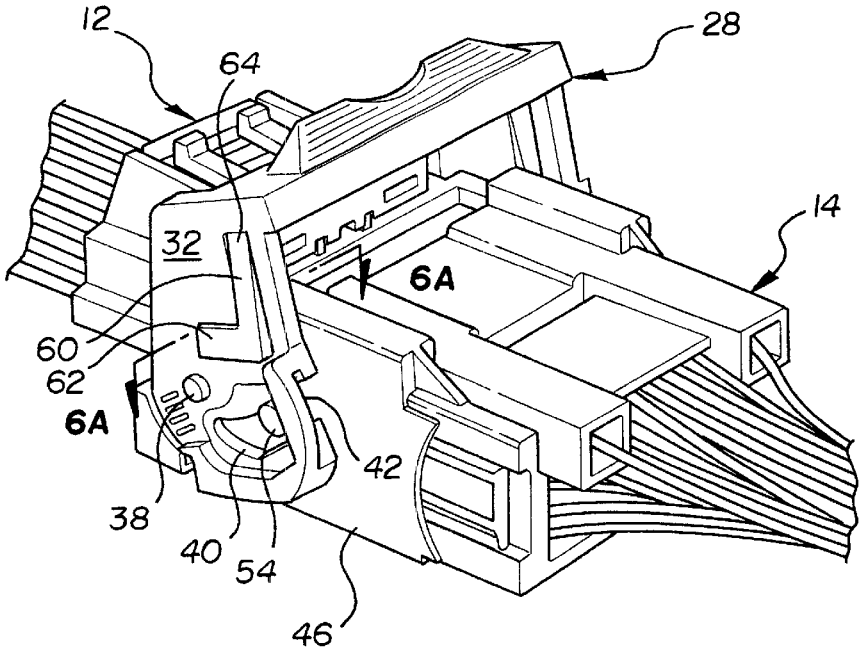
FIG. 6 is a perspective view of the connector assembly from the mating (second) connector side just after the initial contact condition of FIG. 3, as the lever is released from its pre-set condition.
Figure 6A:
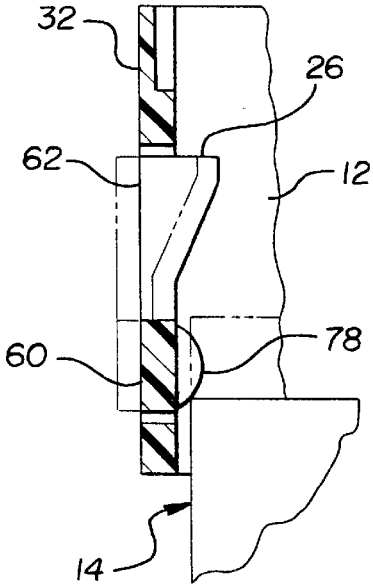
FIG. 6A is a close-up plan view of the lock arm pre-set stop as in FIG. 5A, but with the lock arm release projection being deflected by the mating connector to disengage the pre-set stop.
Figure 7:
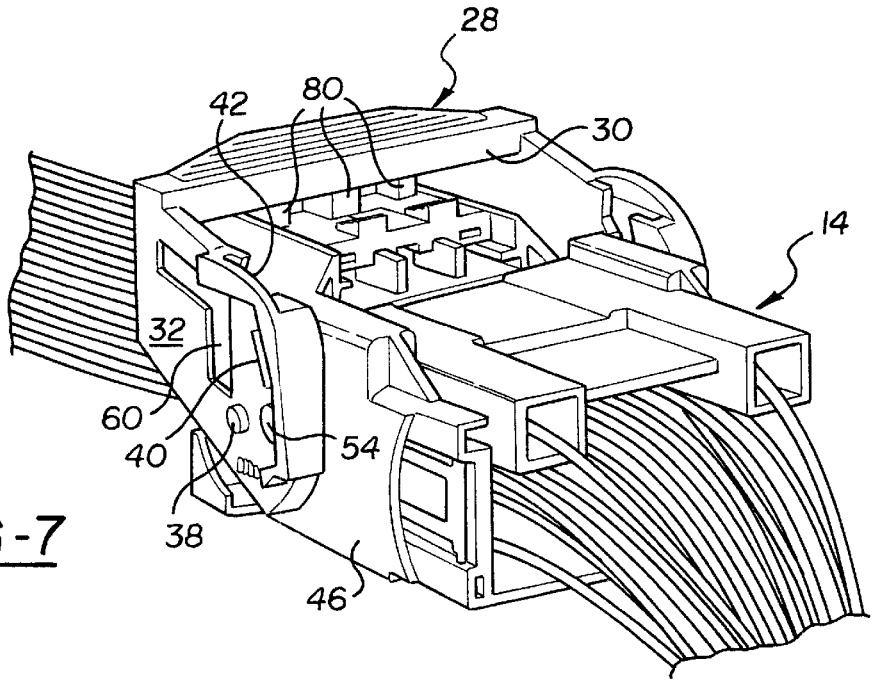
FIG. 7 is a perspective view of the fully mated connectors with the lever rotated down and latched to the connector body.
Figure 8:
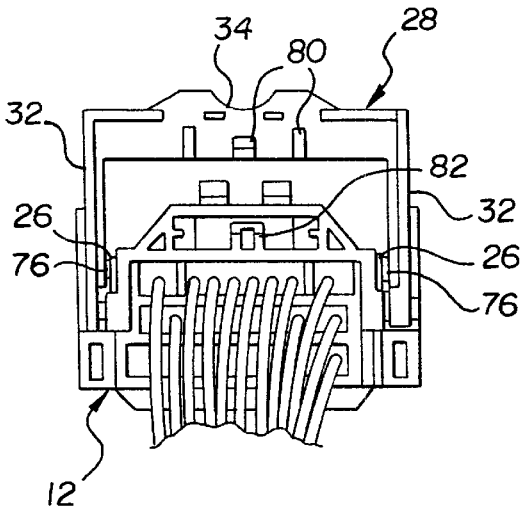
FIG. 8 is a rear elevational view of the lever (first) connector in the pre-set condition of FIG. 5.
Figure 9:
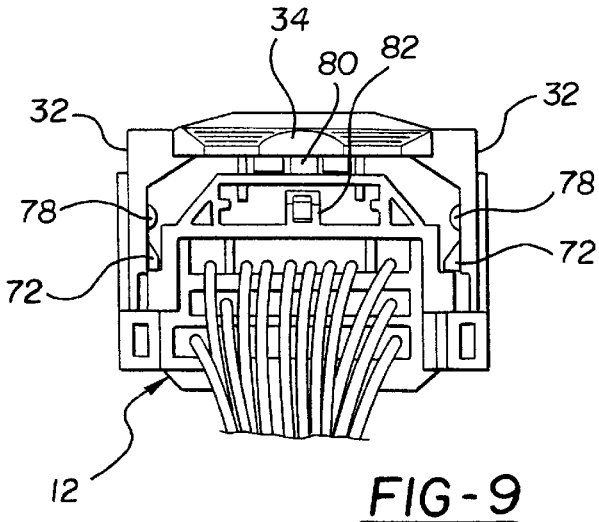
FIG. 9 is a rear elevational view of the lever (first) connector with the connectors fully mated and the lever closed down and latched on the connector body.

As demonstrated in FIGS. 6 and 6A, when the connectors are initially mated the shroud 46 of connector 14 receives housing 16 of first connector 12 and encounters release dimples 78. As shroud 46 slides further over connector 12, dimples 78 and L-shaped arms 60 are forced outwardly in a direction away from side walls 20 of the first connector 12 until flat lower stop surface 76 on ramp 72 clears ridge 26. The lever 28 is thereby released from the pre-set position as cam posts 54 of mating connector 14 enter openings 42 of curved cam slots 40 in lever sidewalls 32. Illustrated slots 40 include a rounded locating notch 40a (FIG. 5) into which posts 54 snap as the lock arms clear the pre-set position. Lever 28 can then be rotated downwardly and rearwardly toward the terminal insertion end 24 of the first connector. The cam action between the slots and posts draws the connectors together as shown in FIG. 7. After the lever has been rotated approximately twenty degrees, the release dimples are disengaged from shroud 46 and lock arms 60 return to their undeflected position. The lock arms encounter no resistance and do not interfere with the movement of the lever as the lever is rotated further through its range of motion (FIG. 7) to its closed position above terminal insertion end 24 of connector 12. When the lever has been rotated approximately 80°, the cam action between the posts and slots has brought the connectors into a fully mated position with the male and female terminals electrically engaged. A conventional latch mechanism 80 on the bridge part 30 of the lever enters a latch receiver 82 on the first connector adjacent the terminal insertion end. The lever is secured in a locked position with the connectors fully mated. The connectors can be separated by releasing the latch mechanism and rotating the lever back to the position shown in FIG. 1.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A lock assembly for holding a connector lever in an open, pre-set position on a connector housing to receive a mating connector, the lock assembly comprising:

a deflectable member attached to a sidewall of the lever;

a stop on the deflectable member for engaging the connector housing in the pre-set position and preventing the lever from being rotated to a closed position; and a release projection on the deflectable member located forwardly of the stop in the lever pre-set position, the release projection being located to contact the mating connector when the mating connector is mated with the connector housing, whereby the mating connector forces the release projection and deflectable member away from the connector housing to disengage the stop from the connector housing thereby releasing the lever from the pre-set position.

2. The lock assembly of claim 1 wherein the projection is a rounded dimple on an inner surface of the deflectable member facing the connector housing.

3. The lock assembly of claim 2 wherein the dimple has a hemispherical shape.

4. The lock assembly of claim I wherein the deflectable member is integral with the lever.

5. The lock assembly of claim 4 wherein the deflectable member is L-shaped and the release projection is located at a crux of the L-shaped member.

6. The lock assembly of claim 5 wherein the L-shaped deflectable member is contained within the sidewall of the lever in its undeflected state.

7. The lock assembly of claim 5 wherein the stop is located on a free end of the L-shaped member.

8. The lock assembly of claim 1 wherein the stop has a ramp portion.

9. The lock assembly of claim 8 wherein the ramp portion faces the connector housing and a flat surface of the stop perpendicular to the deflectable member abuts a portion of the connector housing to lock the lever in the open position.

10. The lock assembly of claim 1 wherein there is a deflectable member on each of two sidewalls of the lever.

11. A connector assembly comprising:

a first connector having a housing and a pivotable lever attached to the housing;

a second connector having a shroud for receiving the first connector housing and cam posts adapted to be received in slots in the lever such that pivoting the lever from a first, pre-set position to a second position electrically mates the two connectors;

a deflectable lock arm on the lever, the lock arm being deflectable relative to the lever and having an inner surface, a fixed end, and a free end;

a stop on the inner surface of the free end of the lock arm for engaging a portion of the first connector housing to secure the lever in the pre-set position; and a release projection on the inner surface of the free end of the lock arm spaced from the stop, the release projection being located so as to be contacted by the shroud of the second connector to deflect the lock arm away from the first connector housing and thereby allow the lever to be pivoted to the second position.

12. The connector assembly of claim 11 wherein the deflectable lock arm comprises an arm formed in a sidewall of the lever, the inner surface of the free end of the lock arm facing the first connector housing.

* * * * *